US010602784B2

(12) United States Patent
Mazzarolo et al.

(10) Patent No.: US 10,602,784 B2
(45) Date of Patent: Mar. 31, 2020

(54) LINING MOUNTED INFLATABLE PROTECTOR AND PROTECTIVE CLOTHING ASSEMBLY

(71) Applicant: Alpinestars Research SRL, Coste di Maser (Treviso) (IT)

(72) Inventors: Giovanni Mazzarolo, Coste di Maser (IT); Colin Ballantyne, Asolo (IT)

(73) Assignee: ALPINESTARS RESEARCH SRL, Coste di Maser (Treviso) (IT)

( * ) Notice: Subject to any disclaimer, the term of this patent is extended or adjusted under 35 U.S.C. 154(b) by 629 days.

(21) Appl. No.: 14/411,194

(22) PCT Filed: Jun. 20, 2013

(86) PCT No.: PCT/EP2013/062865
§ 371 (c)(1),
(2) Date: Dec. 24, 2014

(87) PCT Pub. No.: WO2014/001189
PCT Pub. Date: Jan. 3, 2014

(65) Prior Publication Data

US 2015/0173433 A1 Jun. 25, 2015

(30) Foreign Application Priority Data

Jun. 26, 2012 (IT) ..... TV2012A0124

(51) Int. Cl.
*A41D 13/018* (2006.01)

(52) U.S. Cl.
CPC ..... *A41D 13/018* (2013.01)

(58) Field of Classification Search
CPC ..... A41D 13/018
See application file for complete search history.

(56) References Cited

U.S. PATENT DOCUMENTS 4,783,853 A 11/1988 Tuber
4,977,623 A 12/1990 DeMarco
(Continued)

FOREIGN PATENT DOCUMENTS

CN 101460217 A 6/2009
DE 20311097 U1 1/2004
(Continued)

OTHER PUBLICATIONS

PCT International Search Report and Written Opinion dated Sep. 17, 2013 for Intl. App. No. PCT/eP2013/062865, from which the instant application is based, 9 pgs.
(Continued)

*Primary Examiner* — Anna K Kinsaul
(74) *Attorney, Agent, or Firm* — Fredrikson & Byron, P.A.

(57) ABSTRACT

The present invention relates to an inflatable lining (20) comprising a control unit (26), at least one inflatable bag (22) and at least one gas source (24). According to the invention, the inflatable lining (20) further comprises automatic enabling means (28) suitable for switching the control unit (26) from a first operative mode to a second operative mode and viceversa. In the first operative mode the control unit (26) is set so as to ignore any identified danger situation, while in the second operative mode the control unit (26) is set for activating the gas source (24) when a danger situation is identified. The automatic enabling means (28) comprise receiving means suitable for acquiring data from at least one external data source and for maintaining the control unit (26) in the first operative mode in case no data can be acquired from the external source or the acquired data identifies an external source incompatible with the lining mounted inflatable protector (20). The present invention also relates to a protective clothing assembly (1) comprising at least one
(Continued)

garment (10), provided with identification means (12), and said inflatable lining (20).

19 Claims, 8 Drawing Sheets

(56) References Cited

U.S. PATENT DOCUMENTS

| | | | | |
|---|---|---|---|---|
| 6,298,487 | B1 | 10/2001 | Mayhew | |
| 2002/0121980 | A1* | 9/2002 | Wan | G06Q 10/087 340/572.1 |
| 2004/0127937 | A1* | 7/2004 | Newton | A61H 9/0078 606/202 |
| 2004/0183283 | A1 | 9/2004 | Buckman et al. | |
| 2005/0033351 | A1* | 2/2005 | Newton | A61H 9/0078 606/202 |
| 2005/0067816 | A1 | 3/2005 | Buckman | |
| 2006/0212986 | A1 | 9/2006 | Mahoney | |
| 2007/0075528 | A1 | 4/2007 | Makabe et al. | |
| 2007/0285231 | A1 | 12/2007 | Leftly et al. | |
| 2011/0154561 | A1 | 6/2011 | Singhal | |
| 2011/0237194 | A1 | 9/2011 | Kojima et al. | |
| 2012/0133490 | A1* | 5/2012 | Downie | G06K 19/0717 340/10.1 |

FOREIGN PATENT DOCUMENTS

| | | | |
|---|---|---|---|
| EP | 0051254 | A1 | 5/1982 |
| EP | 1668999 | A1 | 6/2006 |
| EP | 2373188 | B1 | 2/2012 |
| WO | 0051453 | A1 | 9/2000 |
| WO | 2005036335 | A2 | 4/2005 |
| WO | 2007123970 | A2 | 11/2007 |
| WO | 2010140176 | A1 | 12/2010 |

OTHER PUBLICATIONS

Fukuda et al., "Clothes that Coordinate Your Fashion Based on Previous Choices," SOTICS 2011: The First International Conference on Social Eco-Informatics, 2011, 5 pages.

European Patent No. 2863767, Grounds of Appeal dated Jul. 31, 2019, 36 pages.

European Patent No. 2863767, Decision Rejecting the Opposition dated Mar. 22, 2019, 23 pages.

European Patent No. 2863767, Notice of Opposition dated Apr. 27, 2017, 30 pages.

* cited by examiner 34
10
32
20

34
10
22
32
22
23A
23A
23B
23B
11
23
23
1
10
20

23B
23A
23

LINING MOUNTED INFLATABLE PROTECTOR AND PROTECTIVE CLOTHING ASSEMBLY

RELATED APPLICATIONS

This application is a 35 U.S.C. 371 national stage filing from International Application No. PCT/EP2013/062865, filed Jun. 20, 2013, and claims priority to Italian Application No. TV2012000124, filed Jun. 26, 2012, the teachings of which are incorporated herein by reference.

The present invention relates to a lining mounted inflatable protector. The invention also relates to a protective clothing assembly comprising a garment and said lining mounted inflatable protector. In particular the present invention refers, even if in a non exclusive way, to a lining mounted inflatable protector and to a protective clothing assembly suitable for being worn by a motorcyclist.

It is well known that, in case of road accidents, motorcyclists have a higher chance to undergo serious injuries in comparison to other road users.

Over the years, for reducing the injury risk, a number of initiatives have been proposed such as the integration of an inflatable protection, or airbag, into the riders clothing.

For example, protective garments, provided with inflatable devices, have been disclosed in EP1668999, U.S. Pat. No. 6,298,487 and in EP0051254. However, it appears that, until now, only few products having protective inflatable devices have been introduced in the market and are actually used by a very restricted number of motorcyclists.

As a matter of fact, their use appears to be discouraged by various reasons such as the higher cost of such protective garments with respect to the normal garments and the need to integrate the inflatable device in the structure of the outer protective garment, unavoidably restricting the design options available to the designers of clothing. Furthermore, the lifespan of such type of protective garment is not very long (on average around three years) with the consequent need of replacement.

In the light of the above mentioned problems and drawbacks, the same applicant has filed an Italian Patent Application (TV2012A000084) which discloses a wearable protector, comprising: a thin layer supporting fabric, at least one inflatable bag housed in a seat provided in said supporting fabric, at least one gas generator acting as inflating means connected to said inflatable bag and fastened directly or indirectly to said supporting fabric, a control unit also fastened directly or indirectly to said supporting fabric and suitable for activating said inflating means and sensing means connected to said control unit and provided in said supporting fabric.

Said wearable protector is a standalone device since all its functional elements, i.e. inflatable bag, sensing means, control unit and gas generator, are arranged on the thin layer supporting fabric. As a matter of fact, after having worn the standalone wearable protector, the user does not have to connect any component of the wearable protector with external devices for making the wearable protector operate.

The wearable protector is a standalone device and thus the user is allowed to use said wearable protector, independently from the usual protective garment, like a leather jacket or suit and from the style thereof.

However, it should be noted that although said wearable protector may be used in combination with different protective garments, the wearable protector is not integrated into the protective garment. Therefore the user must always wear the wearable protector in a separate operation, either before or after having worn the protective garment. Furthermore, even if such wearable protector allows to solve the drawbacks above mentioned, for accomplishing in the best way its safety function, another problem exists as regards the compatibility of the wearable protector with other garments that the user normally combines therewith.

As a matter of fact, in the event that the wearable protector is not used with a compatible garment, the inflatable bags may not be correctly positioned over the body's portions to be protected. Moreover, if the wearable protector is not used with a compatible garment, the proper inflation of the inflatable bags may be hindered by the garment worn above the protector. Furthermore, if the wearable protector is not used with a compatible garment, the inflation of the inflatable bags may result in a dangerous compression of the body areas in vicinity of the airbag. Therefore, being the wearable protector completely standalone, i.e. fully functional on its own, there may be a risk that certain users attempt to use the wearable protector with garments which have not been designed to be compatible with the protector. This could result in an improper or even dangerous functioning of the wearable protector in the event it is activated in an accident.

The object of the present invention is to provide a lining mounted inflatable protector which solves at least partially the above mentioned problems and drawbacks.

In particular, an aim of the present invention is to provide a lining mounted inflatable protector suitable for being activated only if it is used in conjunction with a compatible garment.

Moreover, another aim of the present invention is to provide a lining mounted inflatable protector suitable for being activated only if it is correctly worn in conjunction with a compatible garment.

A further aim of the present invention is to provide a lining mounted inflatable protector suitable for being correctly fixed to a compatible garment.

Another aim of the present invention is to provide a protective clothing assembly comprising a lining mounted inflatable protector and a compatible garment suitable for being easily maintained and, after having been used, brought back to a proper operating condition.

At last, a further aim of the present invention is to provide a protective clothing assembly which can be worn in a simple way and which allows the user to wear the lining mounted inflatable protector and the compatible garment in a single operation.

These and other objects and aims are achieved by the lining mounted inflatable protector according to claim 1 and by the protective assembly according to claim 4.

The advantages and the characteristic features of the invention will appear more clearly from the following description of a preferred, but not exclusive, embodiment of the lining mounted inflatable protector and of the protective clothing assembly with reference to the accompanying figures in which.

Figure 1:
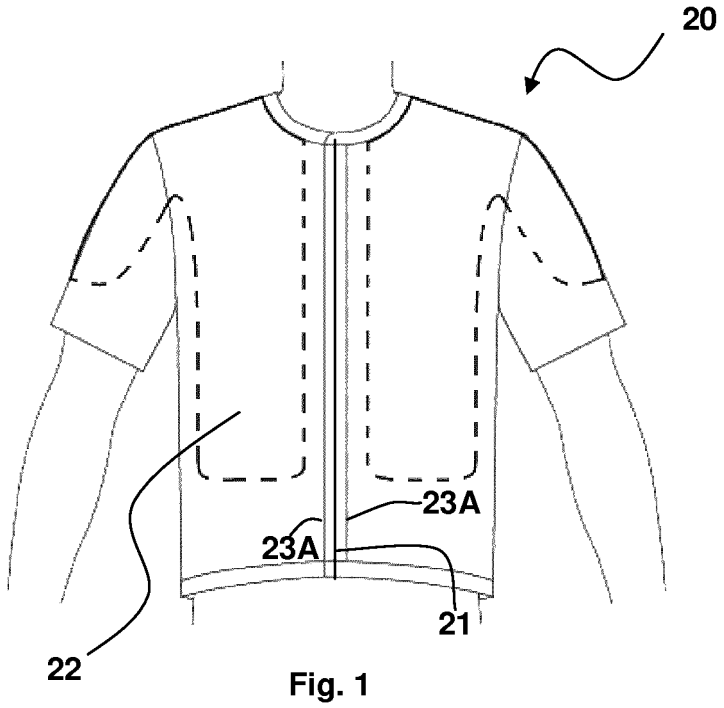
FIG. 1 shows a front view of a first embodiment of a lining mounted inflatable protector according to the invention.

In the following description, as "lining" there will be indicated a component of clothing suitable for covering, at least partially, the inside surface, i.e. the surface facing the user, of a garment. Specifically, as "lining" there will be indicated a component suitable for being temporarily attached to the inside of an outer garment worn by a user.

Moreover, as "inner surface" or "inner portion" there will be indicated the surface or portion of a lining and/or garment, and their individual components that, when the lining and/or garment are in use, i.e. are worn by a user, are relatively closer to the body of the user, while as "outer surface" or "outer portion" there will be indicated the surface or portion of a lining and/or garment, and their individual components that, when the lining and/or garment are in use, is outwardly opposite to the inner surface or portion.

With reference to the attached figures, an example of a lining mounted inflatable protector according to the invention is indicated as a whole by the reference 20. For sake of clarity, hereinafter the lining mounted inflatable protector 20 will be named inflatable lining. Said inflatable lining 20 is suitable for being used in particular by motorcycle riders. Nevertheless, as it will appear more clearly from the following description, the inflatable lining 20 can also be advantageously used by cyclists or in other fields where an effective protection of the user's body must be obtained.

The inflatable lining 20 comprises at least one inflatable bag 22 and at least one gas source 24.

The inflatable bag 22 is housed in a seat 25 provided in the inflatable lining 20. The gas source 24 is fastened to the inflatable lining 20, preferably in a removable way. Said at least one gas source 24 is suitable, when it is activated, for inflating the at least one inflatable bag 22.

The inflatable bag 22, like a common air bag, has the function, once it has been inflated, to protect the body of the rider against impact with other vehicle or objects by absorbing, or at least cushioning, the impact forces acting against the user's body.

The gas source 24 may consist of a cylinder containing a compressed gas. Alternatively, or in addition, the gas source 24 may be a canister containing chemical products suitable for generating, owing to a chemical reaction, a gas for filling and inflating the inflatable bag. These embodiments are well known per se to the person skilled in the art of air bags.

The inflatable lining 20 also comprises sensing means 30; 30A and a control unit 26. The control unit 26 is fastened to the inflatable lining 20 and it is suitable for processing the data provided by the sensing means 30; 30A in order to identify a danger situation.

According to the invention, the inflatable lining 20 further comprises automatic enabling means 28 suitable for switching the control unit 26 from a first operative mode to a second operative mode and viceversa. As automatic means must be intended means which are suitable for properly accomplishing their function without needing a user to operate them.

According to the invention, in the first operative mode the control unit 26 is set so as to ignore any identified danger situation, while in the second operative mode the control unit 26 is set for activating the gas source 24 when a danger situation is identified.

According to the present invention, as "ignoring any identified danger situation" there is meant a condition in which, even if the sensing means 30, 30A detect a danger situation, the control unit 26 does not fire the gas source 24 and thus the inflatable bag 22 is not inflated.

Advantageously, the inflatable lining 20 can be provided with a central opening 21 suitable for making easier to the user the wearing of the lining (see FIG. 1).

The inflatable lining 20 preferably is made from a fabric having a reduced thickness, e.g. comprised between 0.3 mm and 0.6 mm, whereby the inflatable lining 20 can be easily worn underneath different garments.

Preferably, the fabric of the inflatable lining 20 is made of polyester, polyamide or aramid fibres.

Preferably, the structure of the inflatable lining 20 comprises at least two layers 20A, 20B such that one or more pockets 25 can be created between the inner layer 20B and the outer layer 20A. Advantageously, the pockets 25 can be created by fixing the inner layer 20B to the outer layer 20A of the inflatable lining 20 by means of stitching 31 (see FIG. 4A). Such pockets 25 can be used to accommodate the various components of the inflatable lining 20, i.e. inflatable bag 22, gas source 24, control unit 26, etc., (see FIG. 4A).

Preferably, the fabric of the inflatable lining 20 has good elastic properties such that it can easily adapt itself to different shapes of the user's body. Furthermore, due to its elasticity, the fabric of the inflatable lining 20 does not obstruct the inflation of the inflatable bag 22 allowing it to reach its maximum volume in a very short time.

The structure of the fabric of the inflatable lining 20 allows the expansion of the inflatable bag 22 to take place towards the outside of the inflatable lining 20, so as to not constrict the user's body.

The inflatable lining 20 preferably comprises a single inflatable bag 22. Preferably said single inflatable bag 22 is accommodated inside a seat 25 arranged on the fabric of the inflatable lining 20. Said seat 25 has the function to keep in a proper position the inflatable bag 22. Preferably, the inflatable bag 22 is housed inside the pocket 25 created between the inner layer 20B and the outer layer 20A of the fabric of the inflatable lining 20 (see FIG. 4A).

Preferably the single inflatable bag 22 is arranged on the fabric of the inflatable lining 20 so as to cover the chest, ribs, shoulders and back of the user.

However, different arrangements of the single inflatable bag 22 are possible, in order to meet further specific needs.

Obviously, the inflatable lining 20 may comprise more than one inflatable bag 22, said inflatable bags 22 being suitable for covering other portions of the body and for operating in combination to each other.

Preferably the inflatable bag 22 is made from a sheet material such as polyamide. A similar inflatable bag is disclosed in the International Patent Publication WO2010/140176 filed in the name of the same applicant.

Said inflatable bag 22 is able to reach a great expansion and it can be inserted inside its seat 25 in a flat configuration without needing to be folded or packed. In this way the provision of inflatable bags on the inflatable lining 20 does not make the latter bulky and does not hinder the user wearing the inflatable lining 20.

Preferably the inflatable lining 20 comprises a single gas source 24. However, a possible alternative embodiment of the invention envisages the use of more than one gas source 24.

In this specific embodiment, if a danger situation is identified by the sensing means 30; 30*a* and the control unit 26 is in its second operative mode, the plurality of gas sources 24 can be activated by the control unit 26 either simultaneously or according to a predetermined sequence.

In this way, in case the inflatable lining 20 contains more than one inflatable bag 22, each inflatable bag 22 can be inflated by a different gas source 24.

Otherwise stated, if the inflatable bag 22 has been provided with an escape vent to allow gradual deflation of the bag, once the bag has been inflated, it will slowly deflate whereby the next gas source 24 can be activated at a different time in future. In this way, the inflatable lining 20 can be reused without needing to undergo maintenance and recharging. In this case, the outer layer 20A of the fabric of the inflatable lining 20, which is superimposed to the inflated bag 22, thanks to its elasticity, can apply a compression force over it assisting the removal of the gas from the inflatable bag 22.

Figure 2:
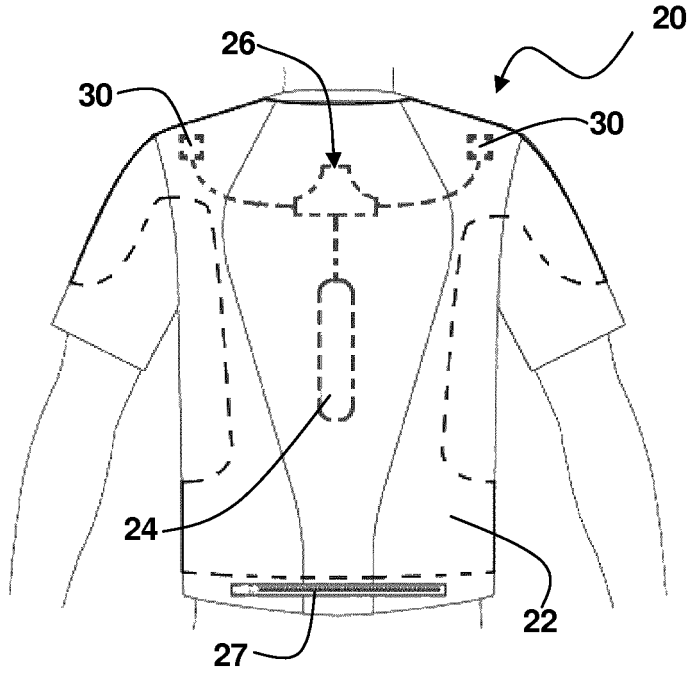
FIG. 2 shows a back view of the lining mounted inflatable protector of FIG. 1.
Figure 3:
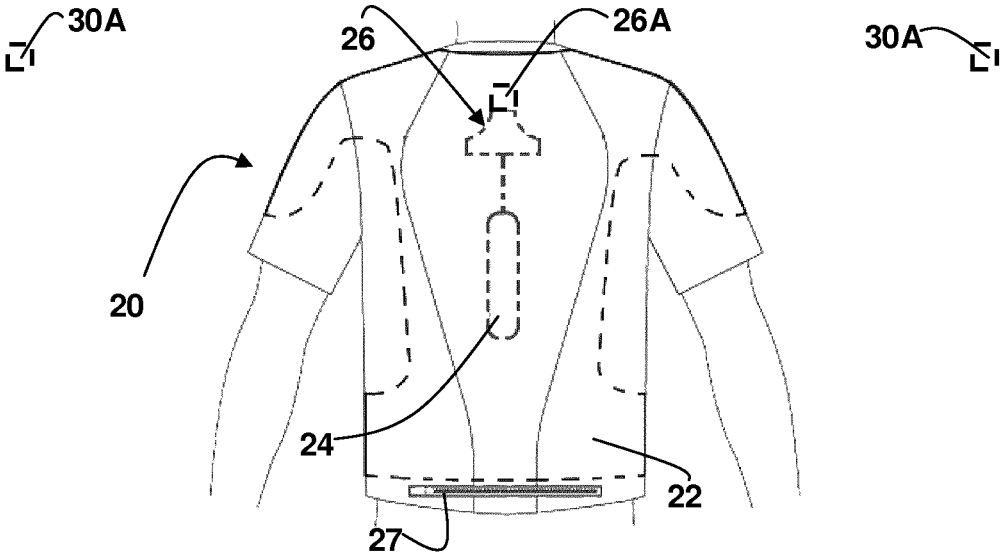
FIG. 3 shows a back view similar to the one of FIG. 2 of a second embodiment of the lining mounted inflatable protector according to the invention.
Figure 4:
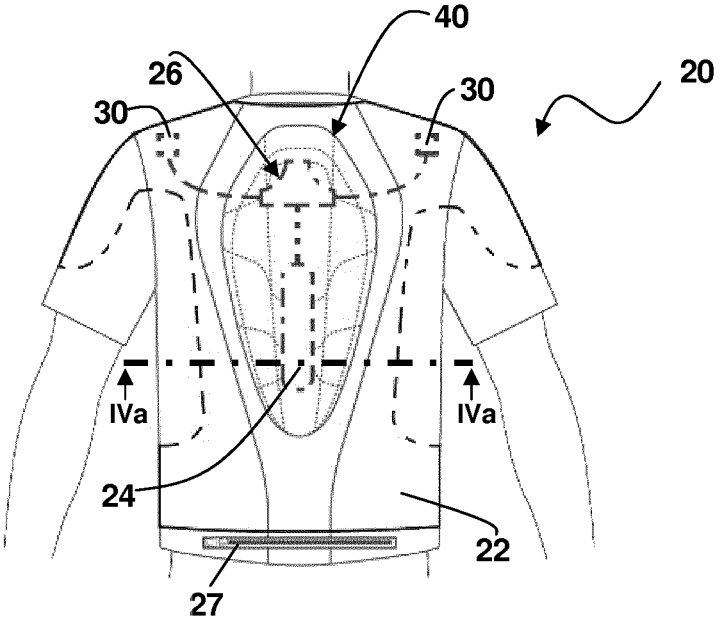
FIG. 4 shows a back view similar to the one of FIG. 2 of a third embodiment of the lining mounted inflatable protector according to the invention.
Figure 4A:
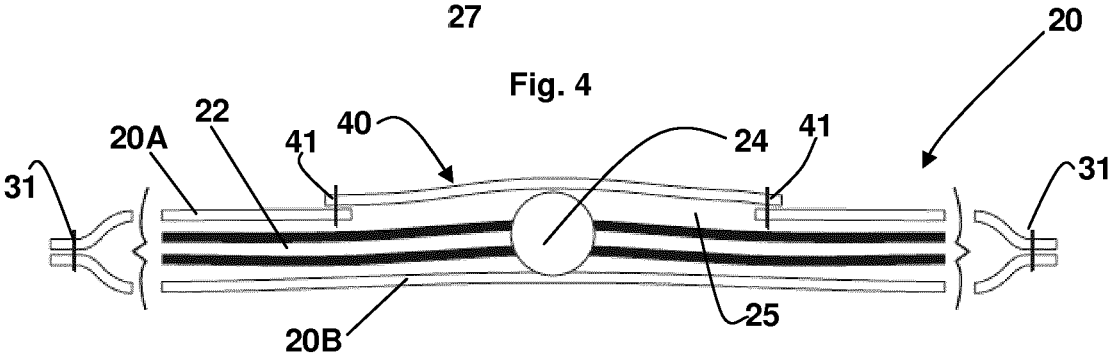
FIG. 4A shows a simplified cross sectional view of the lining mounted inflatable protector of FIG. 4 according to the plane IVa-IVa.

Advantageously, the inflatable lining 20 can be provided at the lumbar portion with an opening 27 suitable for being closed by closing means, like zip or Velcro® fasteners (see FIGS. 2, 3 and 4). After having opened the closing means, the user can have access to the portion of the inflatable lining 20 wherein the gas source 24 is housed. Through the opening 27 the user is able to replace the empty gas source 24 with a new one, if it is needed.

As it is shown in FIG. 4, the gas source 24 advantageously can be housed inside a protective element 40 provided on the back portion of the inflatable lining 20; said protective element 40 being in turn fastened to the inflatable lining 20. Preferably, the protective element 40 is fastened to the inflatable lining 20 by means of stitching 41 (see FIG. 4A).

The inflatable lining 20 can also be provided with additional protective elements suitable for covering other body's portion, like for example, shoulders and elbows. Such embodiments are not shown on the attached figures, however protective elements designed for protecting shoulder and elbows are well known to a skilled person.

The gas source 24, like other components of the inflatable lining 20, can be freely positioned anywhere on the fabric of the inflatable lining 20.

As already mentioned, the inflatable lining 20 further comprises sensing means 30; 30A suitable for providing data to the control unit 26 in order to identify danger situations. Said sensing means 30; 30A are preferably accelerometers. According to the embodiments shown in FIGS. 2 and 4, said sensing means 30 can be arranged on the fabric of the inflatable lining 20.

Said sensing means 30 can be positioned in different areas of the inflatable lining 20 (in the embodiments shown in the attached figures, for sake of clarity, only the sensors positioned on the shoulder portion of the inflatable lining 20 are shown).

According to the embodiment shown in FIG. 3, in addition or in alternative to the sensing means 30 provided on the fabric of the inflatable lining 20, sensing means 30A can also be positioned externally to the inflatable lining 20. In this occurrence, the sensing means 30A can thus be installed on the motorcycle driven by the user or on a garment worn in conjunction with the inflatable lining 20.

The sensing means 30; 30A are connected by means of wired and/or wireless connections to the control unit 26 of the inflatable lining 20.

If the sensing means 30; 30A are connected to the control unit 26 by means of a wireless connection, the control unit 26 will be provided with a proper receiver 26A (see FIG. 3).

The control unit 26 is suitable for continuously monitoring, through the data provided by the sensing means 30; 30A, the behaviour of the user and/or the behaviour of the motorcycle driven by the user. As a matter of fact, the control unit 26, by processing the data provided by the sensing means 30; 30A, is able to identify (according to a triggering algorithm) a danger situation for the user, due for example to a sudden deceleration of the motorcycle or to an unexpected movement of the body of the user.

In its first operative mode, the control unit 26, even if a danger situation for the user is identified, does not provide any activation input to the gas source 24, i.e. it does not transmit to the gas source 24 a fire signal for permitting the inflation of the inflatable bag 22.

In its second operative mode, the control unit 26, after having identified a danger situation for the user, is able to instantaneously transmit a fire signal to the gas source 24 leading to a rapid inflation, in approximately 30-100 ms, of the inflatable bag 22.

The switching of the control unit 26 from its first operative mode to its second operative mode (and viceversa) is operated by the automatic enabling means 28 of the inflatable lining 20.

The function of the automatic enabling means 28 is to prevent the inflatable lining 20 from being used in an incorrect manner and/or, as it will be explained in detail in the following, in conjunction with a non-compatible garment.

Preferably, the automatic enabling means 28 comprise receiving means for acquiring data from at least one external source, like for example a garment, used in conjunction with the inflatable lining 20.

Considering the case in which the wearable protector is used in conjunction with a garment, the enabling means 28 are suitable, for example, for verifying whether such garment is provided with an identification code.

In the affirmative case, the receiving means are suitable for acquiring the identification code of the garment and for verifying whether the acquired code identifies a garment compatible with the inflatable lining 20.

If the acquired code identifies an external source, for example a garment, compatible with the inflatable lining 20, the enabling means 28 are suitable for switching the control unit 26 in the second operative mode. In case no code can be acquired or the acquired code identifies an external source incompatible with the inflatable lining 20, the enabling means 28 are suitable for maintaining the control unit 26 in the first operative mode.

Preferably, the enabling means 28 comprise a radio frequency identification reader. Said radio frequency reader can be incorporated inside the control unit 26 (see FIG. 8). As it will be explained in detail in the following, said radio frequency reader is suitable for reading an identification code of a chip mounted in an outer garment.

In other embodiments, the radio frequency reader is mounted elsewhere in the inflatable lining 20 and connected to the control unit 26 by means of wired and/or wireless connections.

In a different embodiment, the enabling means 28 comprise coupling means suitable for connecting the inflatable lining 20 to an external device (e.g. the garment used in combination with the protector) so as to allow the data communication between the external device and the enabling means 28.

From the above description, it can be appreciated that the structure of the inflatable lining 20 allows the latter to be used in combination with a generic garment 10 so as to form a clothing assembly.

However, it should be noted that the inflatable lining 20 is not able to properly accomplish its safety function if worn underneath a generic garment. As a matter of fact, the garment worn on top of the inflatable lining 20 could interfere with the inflation of the inflatable bag 22. Such inflation, in case of a danger situation, could take place inwards towards the body of the user rather than outwards.

For solving such technical problem, in the already mentioned Italian Patent Application (TV2012A000084), the same applicant has also disclosed a protective garment suitable for being used in conjunction with a standalone wearable protector. Said protective garment is provided with yielding areas suitable for being at least partially superimposed over the at least one inflatable bag of the standalone wearable protector, when the latter is worn underneath the compatible garment.

The yielding areas have the function to allow the expansion of the inflatable bag once, following to the detection of a crash situation, the inflatable bag is inflated by the gas source of the standalone wearable protector.

Therefore, advantageously the user could use the inflatable lining 20 as above disclosed with a protective garment having yielding areas properly positioned over the inflatable bag (or over the inflatable bags) of the wearable protector.

However, the user cannot be prevented from combining, voluntarily or unintentionally, the inflatable lining 20 of the present invention with a non compatible garment, i.e. with a garment lacking yielding areas suitable for allowing a proper inflation of the inflatable bag.

Therefore, for assuring a high safety level and for avoiding an improper use of the inflatable lining 20, a novel and innovative protective clothing assembly 1 according to the invention has been conceived.

Such protective clothing assembly 1 comprises at least one garment 10, which is provided with identification means 12 adapted to identify said at least one garment 10, and the inflatable lining 20 above disclosed. The inflatable lining 20 is suitable for being removably fastened to the inside of the garment 10.

According to the invention, the enabling means 28 of the inflatable lining 20 are suitable for recognizing the identification means 12 of the garment 10 and for switching the control unit 26 in its second operative mode if the identification means 12 identifies a compatible configuration of the garment 10 with respect to the inflatable lining 20.

Similarly, the control unit 26 is suitable for maintaining the control unit 26 in its first operative mode if the identification means 12 identifies an incompatible configuration of the garment 10 with respect to the inflatable lining 20.

As "incompatible configuration" there is meant a configuration of the garment which prevents a correct inflation of the inflatable bag, reducing the safety level offered by the inflatable lining 20 or, in some specific cases, exposing the user to injuries or damages.

For example, an incompatible configuration of the garment with respect to the inflatable lining 20 is represented by a garment having different size with respect to the inflatable lining. Again, as another example of an incompatible configuration occurs when the outer garment is provided with rigid or semi-rigid protective elements that due to their position do not allow a correct inflation of the inflatable bag. A different incompatible configuration occurs when the garment lacks yielding areas or its yielding areas are not superimposed to the inflatable bag of the inflatable lining. Another incompatible configuration occurs when an opening of the garment has not been correctly closed, for example when the front opening is not fully closed by a zip fastener. Another example of an incompatible configuration is when the garment lacks identification means or, even if it is provided with features adapted to properly work in conjunction with the inflatable lining 20, has been manufactured by a non authorized manufacturer.

The identification means 12 are preferably suitable for storing classification data of the garment 10. As "classification data" of the garment 10 there are meant data which may include information concerning for example model, size, colour, place of production of the garment. Specifically, the information concerning the model of the garment may comprise information concerning the number and the extension of the yielding areas and the position of the yielding areas.

Among the classification data of the garment 10 there are advantageously included also data showing whether the garment has been correctly worn or fastened.

Preferably, the identification means 12 of the garment 10 comprise a radio frequency identification means 16.

Figure 8:
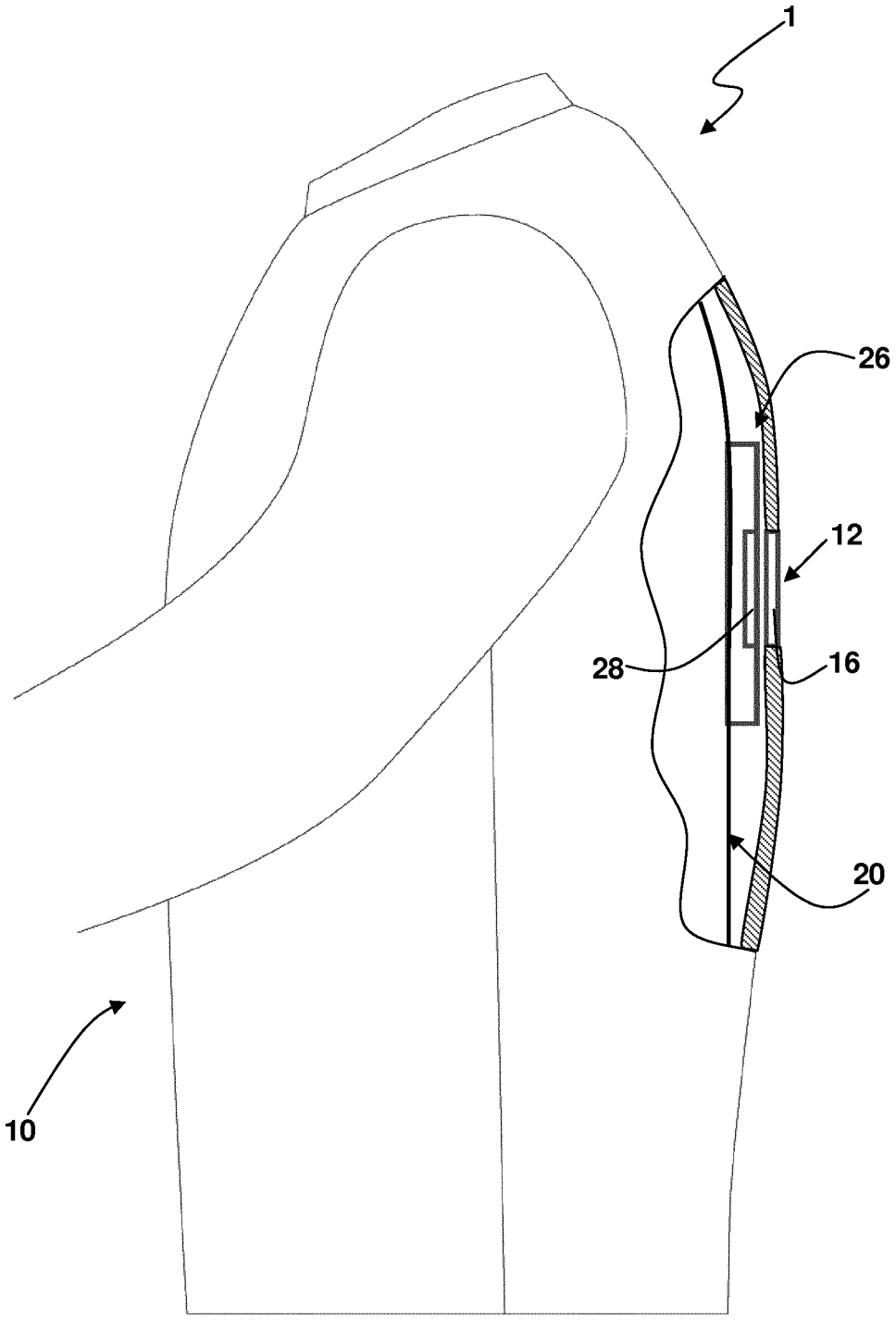
FIG. 8 shows a side view, in partial cross-section, of a further embodiment of the protective assembly according to the invention.

According to the embodiment of the protective clothing 1 shown in FIG. 8, the control unit 26 of the inflatable lining 20 can incorporate a radio frequency identification reader 28 acting as enabling means. At the same time the garment 10 shall include a radio frequency identification chip 16 sited in a position suitable for remaining within the range of the radio frequency identification reader of the inflatable lining, provided that the latter is correctly installed inside the garment 10.

When the inflatable lining 20 is combined with the garment 10, the radio frequency reader 28 is able to read the code present on the radio frequency identification chip 16 (if present) and if the code identifies a compatible configuration of the garment 10 with respect to the underneath inflatable lining 20, the radio frequency reader 28 switches the control unit 26 from its first operative mode to the second operative mode.

Thus each garment size and style may have for example a different radio frequency identification chip 16 and then the radio frequency reader 28 is able to check whether the inflatable lining 20 has been installed inside a garment of corresponding size, or of corresponding configuration.

Additionally, the use of a unique radio frequency identification chip 16 for each garment 10 could be used for implementing a security feature such that if the inflatable lining 20 was stolen and somebody tried to install it inside another compatible garment 10, but not the one of the lawful owner, the radio frequency reader 28 can switch by default the control unit 26 in its first operative mode.

Figure 9:
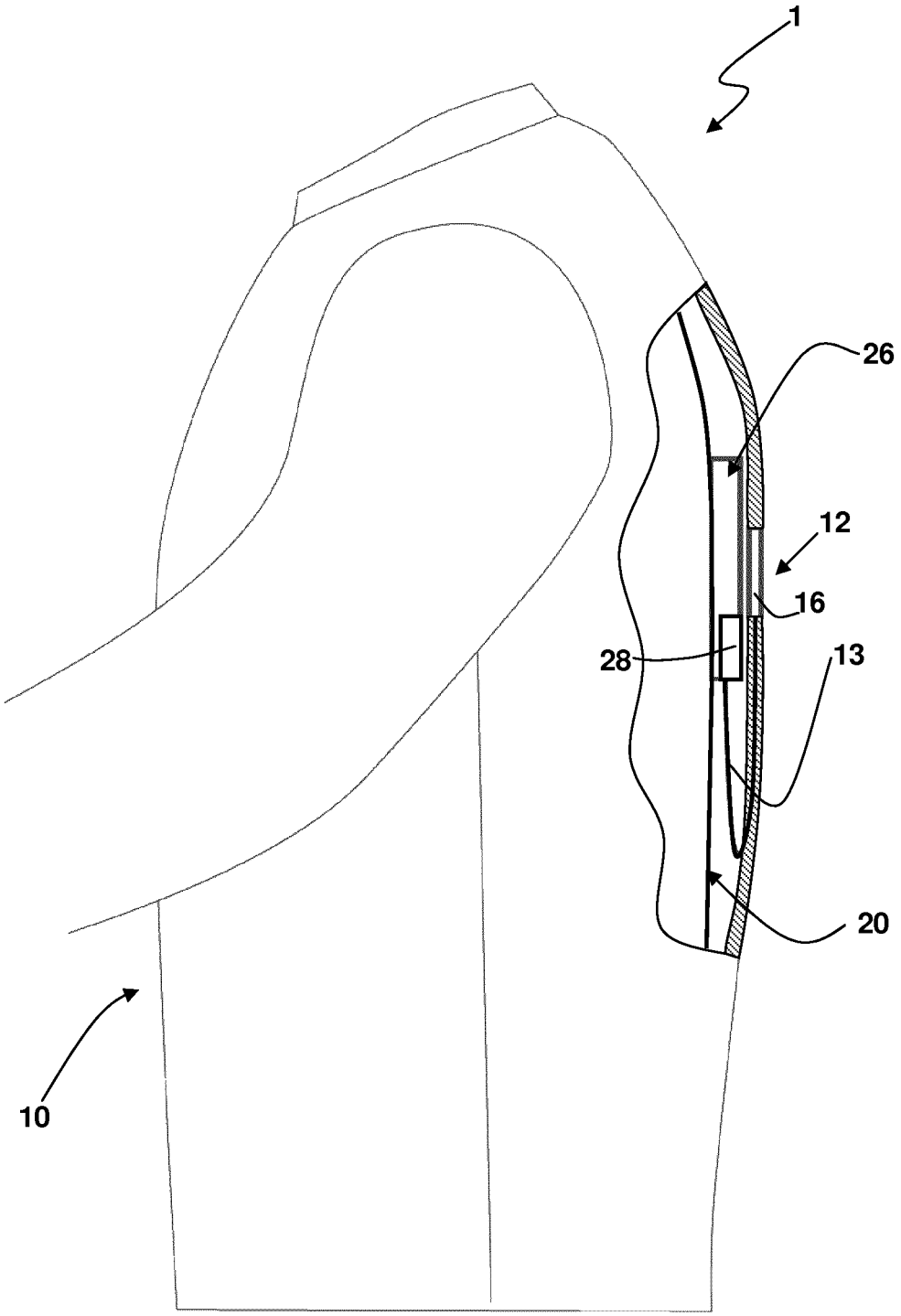
FIG. 9 shows a side view similar to the one of FIG. 8 of a different embodiment of the protective assembly according to the invention.

In FIG. 9 it is shown an embodiment of the protective assembly 1 wherein the enabling means 28 of the inflatable lining 20 and the identification means 12 of the garment 10 can be connected to each other by means of wires 13.

In this embodiment the garment 10 is provided with an identification chip 16 having a cable 13 connected thereto. Once the inflatable lining 20 has been installed inside the garment 10, the user must plug the cable 13 into the coupling means of the enabling means 28. Preferably, the cable 13 is provided at its end with a plug 33 suitable for being inserted in a correspondingly shaped socket 38 acting as coupling means of the enabling means 28 (see FIGS. 11 and 12) so as to connect the inflatable lining and the garment. In a similar way, to the previous disclosure, the enabling means 28 are suitable for reading, through the cable 13, the classification data stored in the identification chip 16 thereby permitting to the enabling means to verify whether the inflatable lining 20 is correctly used. In case the enabling means 28 read a compatible code, the enabling means 28 switch the control unit 26 to its second operative mode.

As explained with reference to the embodiment using radio frequency reader and chip, the identification code of the garment 10 can be varied depending on the garment size and style.

It should be noted that the enabling means 28 are also suitable for switching the control unit 26 from its second operative mode to its first operative mode and viceversa, also during the normal use of the protective clothing assembly, i.e. after having carried out the first identifying (or initializing) procedure. As a matter of fact, for example if, during the normal use, the garment 10 or the inflatable lining 20 move one relative to other and thus the radio frequency chip goes out from the reading range of the corresponding reader or the cable is accidentally detached from the coupling means of the enabling means (or for example, if the plug 33 goes out from the socket 38), the latter, lacking a signal from the garment, instantaneously switches the control unit to its first operative mode. In this case, the control unit 26 can be provided with proper means (e.g. acoustic means) suitable for indicating to the user that the control unit 26 has been switched by the enabling means 28 to its first operative mode.

Figure 10:
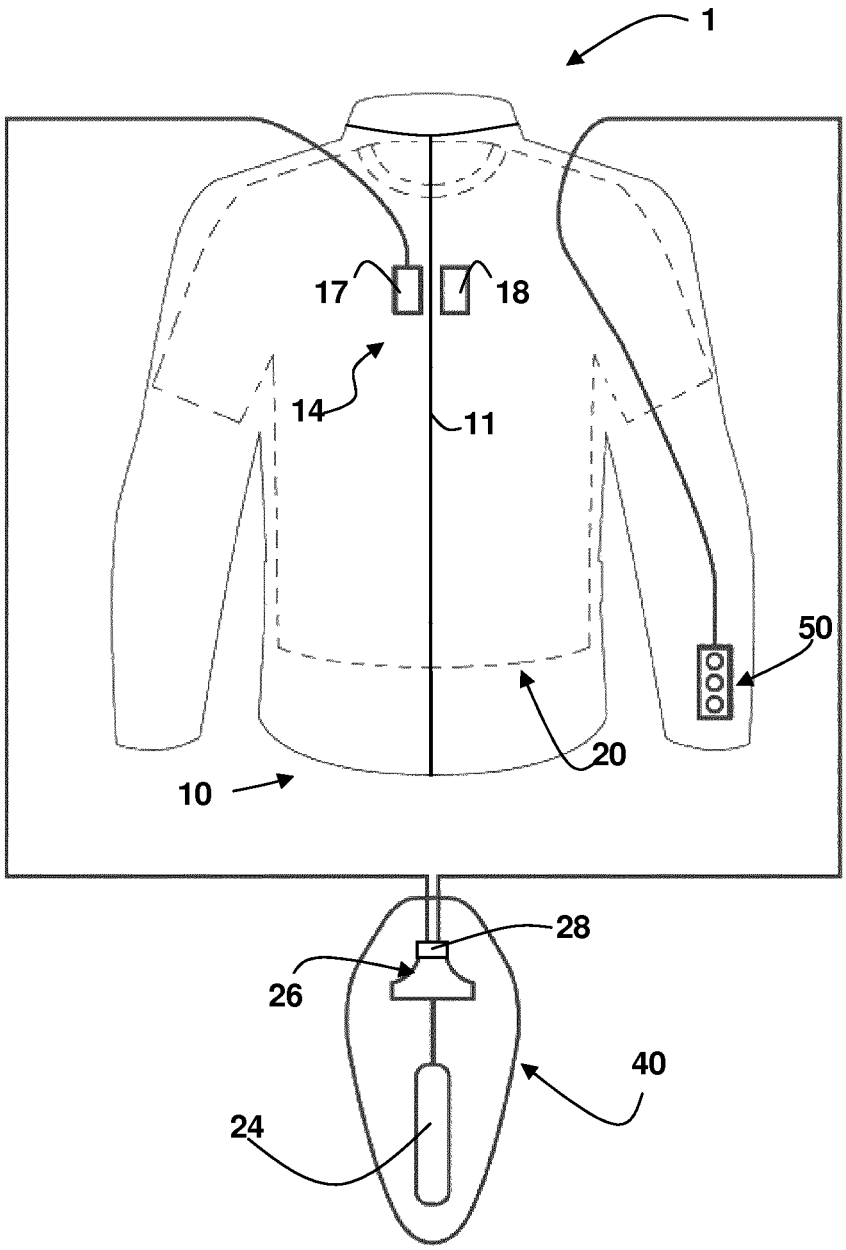
FIG. 10 shows a schematic view of the connections between some components of the protective assembly according to the invention.

In FIG. 10 a further embodiment of the protective clothing assembly 1 according to the invention is shown.

In detail, in this embodiment the garment 10 further comprises signalling means 14 suitable for generating signal configuration data. In this case, the enabling means 28 of the inflatable lining 20 are also suitable for reading said signal configuration data and for switching the control unit 26 to the first operative mode if the configuration data identify an incorrect wearing of the garment 10.

Preferably, the signalling means 14 are positioned at an opening of the garment.

As it is shown in FIG. 10, the signalling means 14 can be advantageously positioned at a front opening 11 of the garment 10.

Signalling means 14 can comprise a reed switch 17 and a magnet 18. Advantageously, the reed switch 17 and the magnet 18 can be mounted on opposite sides of the front opening 11 of the garment 10. When the front opening 11 of the garment is fully closed the reed switch 17 will be activated by the localised magnetic field of the magnet 18. However, if the front opening 11 of the garment 10 is not correctly closed, the reed switch will no longer be activated by the magnet 18, due to the increased distance between the reed switch 17 and the magnet 18.

The enabling means 28 are suitable for reading the signal transmitted by the signalling means 14 (i.e. the activation or the non activation of the magnet) and if the opening 11 of the garment 10 has not been properly closed, the enabling means 28 are able to switch the control unit 26 to its first operative mode. At the same time, if the opening 11 of the garment has been properly closed, the enabling means 28 are able to switch the control unit 26 to its second operative mode.

The signalling means 14 accomplish an important safety feature since, if the gas source 24 of the inflatable lining 20 is activated with the opening 11 of the garment 10 not properly closed, there is a risk that the rapid inflation of the inflatable bag 22 causes the opening of the garment 10. In such occurrence, the inflatable bag 22 can move away from the parts of the body that it should be protected.

It should be noted that different arrangements of the signalling means 14 are possible, in order to meet further specific needs (for example the signalling means can be arranged at a side opening of the garment).

According to the embodiment shown in FIG. 10, the garment can further comprise a display 50. Such display 50 is preferably mounted on the outer surface of the garment 10 in a position where it can be easily seen by the user. For example the display 50 can be applied on one of the sleeves of the garment 10. Such display 50 is suitable for communicating to the user whether the control unit 26 is in its first or second operative mode. The display 50 can also inform the user of a wrong functioning of the control unit, due for example to a power supply problem or to a malfunctioning of one of the components of the inflatable lining 20.

According to the embodiment shown in FIG. 10, the signalling means 14 and the display 50 are both connected to the control unit 26 by means of wired connections.

In this case, the identification means 12 of the garment could be integrated into either the switch 17 or the display 50 or alternatively the identification means 12 could be included in the switch 17 and in the display 50 to ensure that the user has connected both devices to the control unit 26 in order to allow the proper functioning of the protector.

If the connection of the display 50 and the signalling means 14 with the control unit 26 is of the wireless type (this embodiment is not shown in the attached figures), the identification means 12 could be integrated into one of those components.

Advantageously, the signalling means 14 could also be used for activating, i.e. for turning on, the control unit 26, it being understood that the switching of the control unit 26, once it has been activated, from its first operative mode to its second operative mode (and viceversa) is in any case operated by the enabling means 28 of the inflatable lining 20.

In detail, the mechanical opening and closing of the reed switch 17 can be used to either directly or indirectly (using a relay or transistor) activate the control unit 26 of the inflatable lining 20.

Advantageously, it is not needed that the identification means 12 of the garment 10 comprise a coded circuit for identifying the garment. As a matter of fact, the identification means 12 can identify the garment 10 by establishing a coupling shape between one of their components and a corresponding component of the control unit 26 of the inflatable lining 20.

Figure 11:
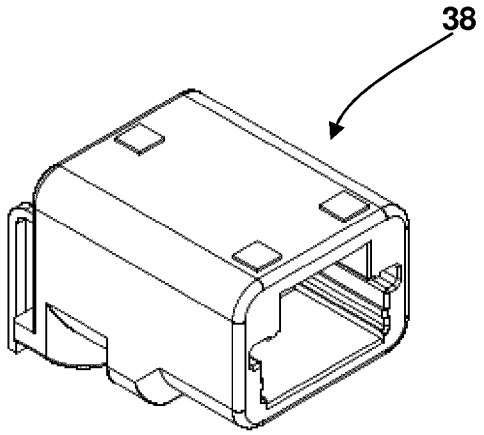
FIGS. 11 and 12 show a perspective view of a first embodiment of the means used for connecting the garment and the lining mounted inflatable protector of the protective assembly according to the invention.
Figure 12:
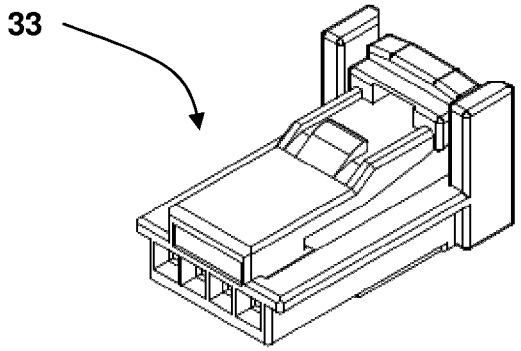

As a matter of fact, in one embodiment the reed switch 17 can be provided with a cable having at its end a plug, manufactured with a certain shape, suitable for being inserted into a corresponding socket of the control unit 26, similarly to the plug 33 and the socket 38 of FIGS. 11 and 12. Therefore, unless the plug of the reed switch 17 matches the socket of the control unit 26 it would not possible for the user to connect the two devices together and activate the control unit 26. In this case, the insertion of the plug inside the socket of the control unit 26 assures that the garment is compatible with the inflatable lining 20, at the same time, once the control unit 26 has been activated, the enabling means 28 are able to monitor the signals transmitted from the reed switch for verifying whether the front opening of the garment 10 has been correctly closed.

Likewise, the display 50 can be provided with a certain shaped plug suitable for being inserted into a second corresponding pocket of the control unit 26. After having connected the display 50 to the control unit 26, the passage of the current between the control unit 26 and the display 50 will cause the turning on of the display, confirming in this way that the display is properly connected to the control unit 26.

Due to the specific shape of the plug of the display 50, the user is prevented from connecting to the control unit 26 displays 50 not specifically designed for functioning with the inflatable lining 20. In this way, the insertion of the plug of the display inside the corresponding socket of the control unit 26 assures that the garment 10 is compatible with the inflatable lining 20.

Figure 6:
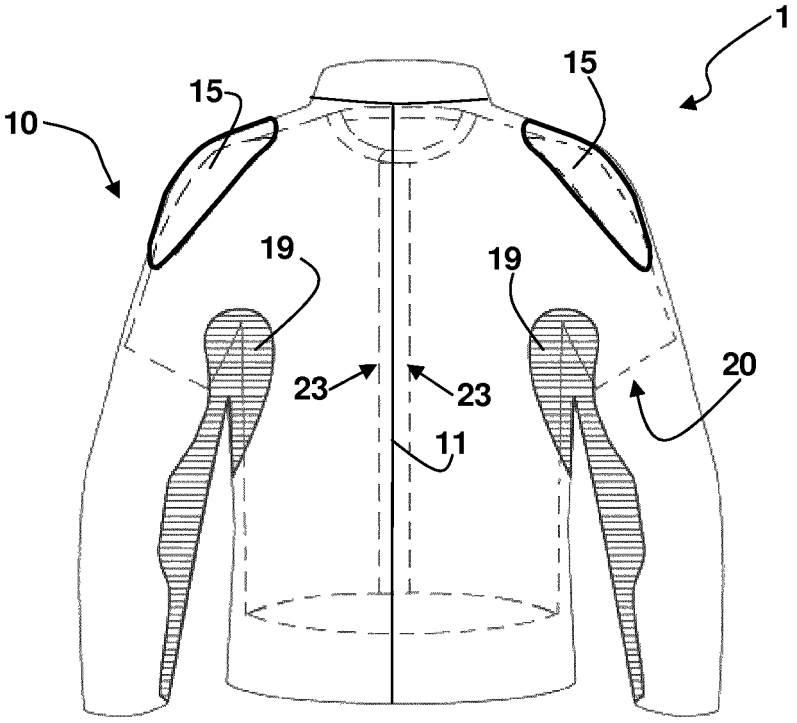
FIG. 6 shows a front view of a second embodiment of the protective assembly according to the invention, in a first operating condition.

In FIG. 6 there is shown the end result when the inflatable lining 20 is correctly installed inside a compatible garment 10 and it is in the deflated state.

In FIG. 6, there is shown a jacket, however the garment used in conjunction with the inflatable lining 20 could be a suit (made by a single piece or by two pieces) or similar protective garment.

Similarly, the inflatable lining 20 shown in the attached figures is suitable for covering the trunk and arm portion of the user. However, different configurations of the inflatable lining 20 are possible in order to meet further specific needs. For example, the inflatable lining 20 can be designed for covering the hip portion and/or the leg portion of the user.

The garment 10 is provided with yielding areas 19 which are substantially superimposed over the inflatable bag 22 of the inflatable lining 20. Said yielding areas are able to allow the inflatable bag 22 to expand after being inflated by the gas source 24 of the inflatable lining 20 (see FIG. 7).

As above mentioned, the inflation of the inflatable bag 22 are made by means of the gas source 24 as soon as the control unit 26, after having processed the data provided by the sensing means 30, 30A, has identified a danger situation.

In this situation, provided that the control unit is in the second operative mode, a signal will be passed by the control unit 26 to the gas source 24 which will cause the rapid inflation of the inflatable bag 22.

Figure 7:
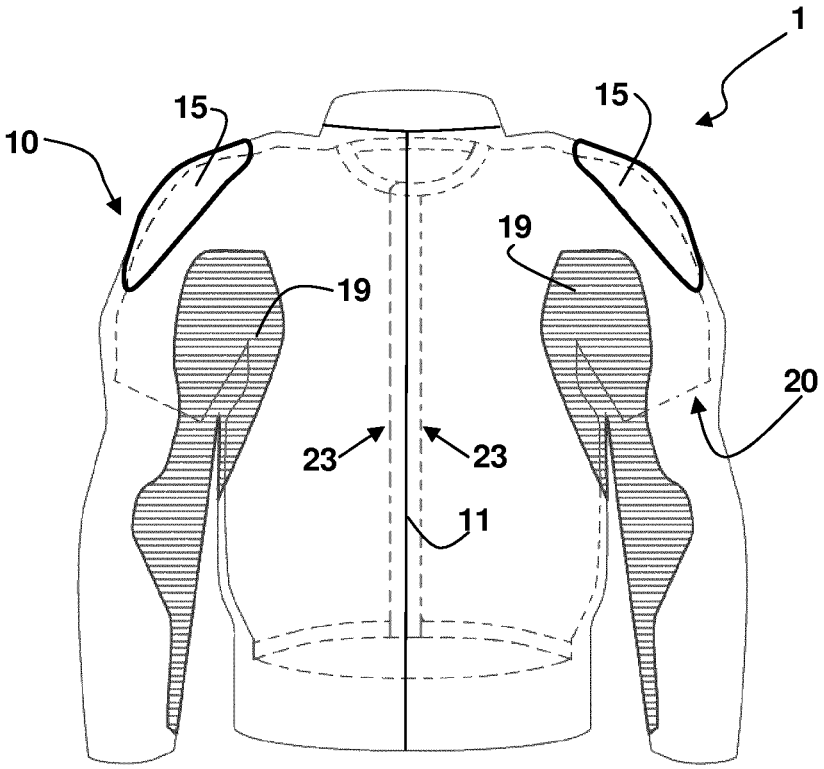
FIG. 7 shows a front view of the protective assembly of FIG. 6, in a second operating condition.

According to the exemplifying embodiment of FIGS. 6 and 7, the compatible garment 10 is provided with yielding areas 19 in the region of the armpits and of the arms. However different arrangements of the yielding areas 19 are possible in order to meet further specific needs. Said yielding areas 19 are preferably made of stretchable material.

According to the exemplifying embodiment of FIGS. 6 and 7, the stretch areas 19 positioned along the arms and armpits portion of the suit 30, allows the portion of the underneath inflatable bag 22, designed for protecting the shoulders, the chest and the back of the user's body, to expand without being hindered by the material of the garment 10.

The yielding areas are useful because when the inflatable bag is filled with gas (or air) it gains thickness and this can cause significant discomfort to the user if there is not additional space inside the outer garment to accommodate this increased thickness. Retaining the inflatable bag 22 inside the outer garment has the advantage that the inflatable bag 22 is protected from abrasion and puncture by the outer garment. Additionally, protective elements, commonly integrated onto the outer garment, can provide further protection to the inflatable bag 22. The exemplifying embodiment of the garment 10 shown in FIGS. 6 and 7 is provided with properly shaped shoulder cups 15.

As it is shown in FIGS. 5, 5A, 5B and 5C, the inflatable lining 20 can comprise first releasable fixing means 32; 23A suitable for cooperating with second fixing means 34; 23B of the garment 10 for temporarily fastening the inflatable lining 20 to the garment 10.

In detail, for attaching the inflatable lining 20 to the garment 10 at the sleeves, preferably a first loop 34 made of narrow fabric or lace material is arranged in the inner surface of the garment 10, while a second loop 32 is provided on the corresponding outer surface of the inflatable lining 20.

The second loop 32 is suitable for being interlinked with the first loop 34 to affix the inflatable lining 20 to the sleeve. Only one loop, between the first and second loop, can be permanently closed. Therefore, by releasing the loop not permanently closed, the inflatable lining can be easily detached from the garment 10, for being attached to a different compatible garment 10, if it is needed.

Figures 5, 5A, 5B, 5C:
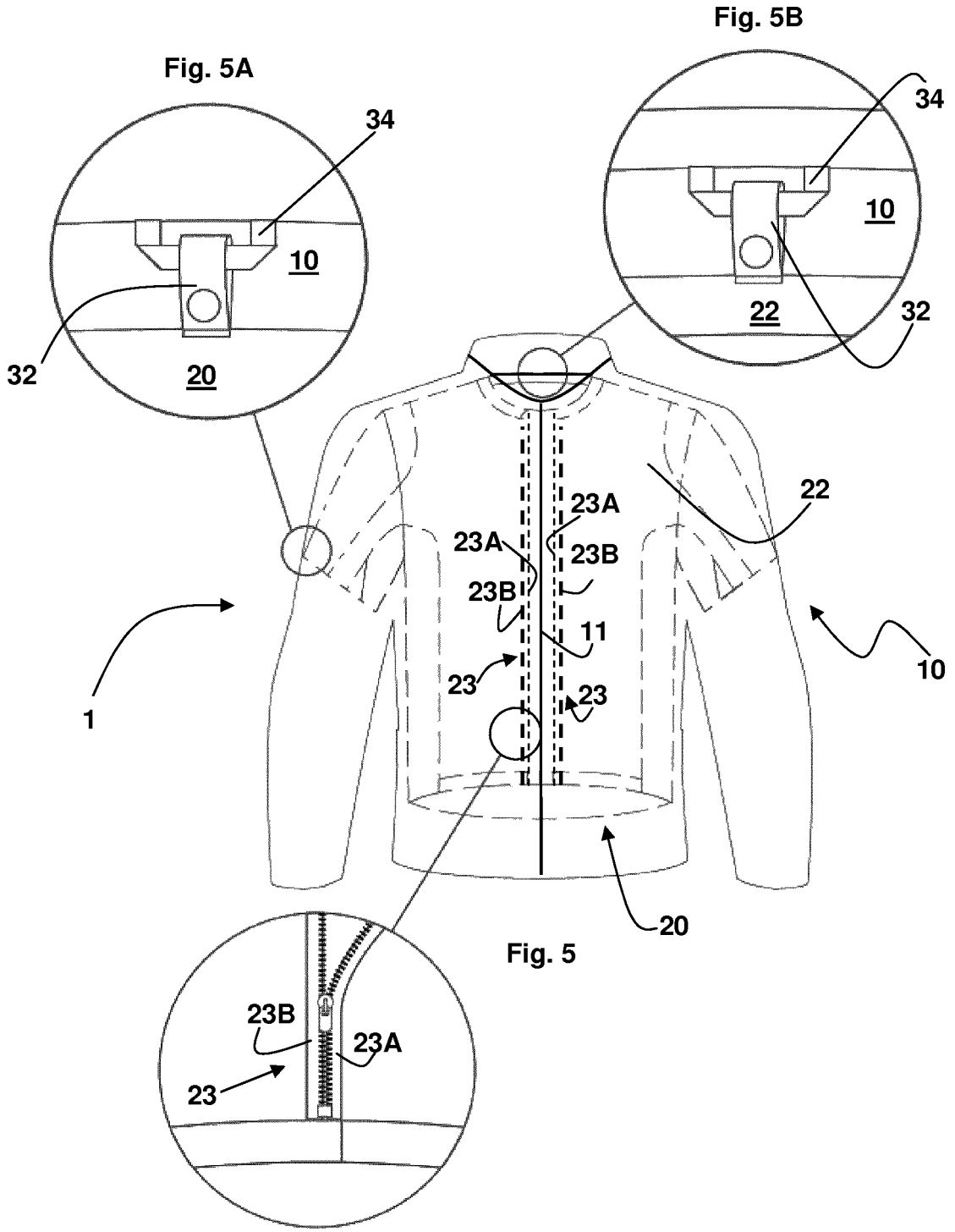
FIG. 5 shows a simplified front view of a first embodiment of the protective assembly according to the invention.
FIGS. 5A, 5B and 5C show enlarged views of the encircled details of FIG. 5.

According to the exemplifying embodiment of FIGS. 5A and 5B, the second loop 32 can be temporarily opened because at its ends it is provided with a releasable press fastener. For affixing the inflatable lining 20 to the outer garment 10 a first end of the second loop 32 is inserted through the first loop 34 on the garment and then clipped to the opposite end of the second loop 32.

This method can also be used for fixing the inflatable lining 20 to the garment at the collar (see FIG. 5B).

The remaining parts of the inflatable lining 20 can be affixed to the garment 10 by the use of zip fasteners 23 which can run, for example, along the opposite sides of the main opening 11 of the garment 10.

Specifically, a first half 23B of the zip fasteners 23 can be installed on the inner surface of the garment 10, while the other half 23A of the zip fasteners 23 can be attached to outer surface of the wearable inflatable lining 20.

By connecting the first half 23B to the second half 23A, the inflatable lining 20 can be affixed to the garment 10.

To affix the inflatable lining 20 to the garment 10 other types of fasteners may be used, like for example hook-and-loop fasteners, magnetic fasteners, spring load clip fasteners and the like.

Also the number and the position of the fasteners can be varied in order to meet further specific needs.

From the above description it is clear that the inflatable lining and the protective clothing assembly according to the present invention have characteristics suitable to advantageously solve the problems and drawbacks set out in the prior art. In particular, by using the inflatable lining and the protective clothing assembly above described, it is possible to allow the inflation of the inflatable bag only if the inflatable lining is used in combination with garments which are manufactured as compatible.

Moreover, the provision of the inflatable lining of the present invention allows to obtain a protective clothing assembly having a simpler structure. Furthermore, the user can buy in different times the inflatable lining 20 and different outer garments 10. For example, the same inflatable lining 20 can be used under a heavy and warm jacket for winter use, under a light jacket or vest for summer use and under a leather jacket or suit for sport use.

Moreover, since the inflatable lining 20 is removably fixed to the outer garment 10, the latter, if it is needed, can also be worn alone, without being provided with the inflatable lining 20.

Furthermore, if the outer garment 10 is damaged, the user can change only the outer garment 10, not being forced to buy a new inflatable lining 20. In this way, the user can also divide the upfront costs that he/she must incur to acquire the whole protective assembly. In addition, a remarkable reduction of the maintenance costs is obtained, since the inflatable lining 20 is advantageously removable from the outer garment 10 and thus, in case, it needs to be maintained, it can be removed from the outer garment and separately repaired.

Finally, by integrating an inflatable protector inside a lining suitable for being removably attached to a protective garment, it is possible to obtain a protective clothing assembly suitable for being worn in a single operation, making the wearing of such protective clothing easier and simpler.

The present invention has been described with reference to a preferred embodiment, but mechanically equivalent solutions are foreseeable falling within the scope of the following claims.

The invention claimed is:

1. Lining mounted inflatable protector comprising:

at least one inflatable bag, said at least one inflatable bag being housed in a seat provided in the lining mounted inflatable protector;

at least one gas source fastened to the lining mounted inflatable protector and connected to said at least one inflatable bag, said at least one gas source being suitable, when activated, for inflating said at least one inflatable bag;

sensing means;

a control unit fastened to the lining mounted inflatable protector and suitable for processing data provided by the sensing means in order to identify a danger situation;

automatic enabling means suitable for automatically switching the control unit from a first operative mode to a second operative mode and vice versa;

wherein in the first operative mode the control unit being suitable for ignoring any identified danger situation and in the second operative mode the control unit being suitable for activating the at least one gas source when the danger situation is identified;

wherein the automatic enabling means is suitable for acquiring data from at least one external data source consisting of a garment worn by user which is separate from, and used in conjunction with, the lining mounted inflatable protector, the automatic enabling means suitable for maintaining the control unit in the first operative mode both in a scenario when no data is acquired from the external source and in a further scenario when data is acquired from the external source and signals an incompatibility relative to fitting between the lining mounted inflatable protector and the garment whereby both scenarios would signal cases in which correct inflation of the at least one inflatable bag would likely not be possible; and wherein the lining mounted inflatable protector is suitable for activating the at least one gas source for inflating the at least one inflatable bag when the sensing means detects the danger situation but only when the control unit is in the second operative mode, and the control unit is suitable for being in the second operative mode but only while the data acquired from the external source identifies the garment as being compatible relative to fitting with the lining mounted inflatable protector.

2. The lining mounted inflatable protector according to claim 1, wherein the automatic enabling means comprise a radio frequency identification reader.

3. The lining mounted inflatable protector according to claim 1, wherein said external source and the automatic enabling means are connected via wire means so as to communicate data there between.

4. Protective clothing assembly comprising:

at least one garment, said at least one garment comprising identification means suitable for identifying said at least one garment;

a lining mounted inflatable protector suitable for being removably fastened to the inside of said at least one garment, said lining mounted inflatable protector comprising:

at least one inflatable bag, said at least one inflatable bag being housed in a seat provided in the lining mounted inflatable protector;

at least one gas source fastened to the lining mounted inflatable protector and connected to said at least one inflatable bag, said at least one gas source being suitable, when activated, for inflating said at least one inflatable bag;

sensing means;

a control unit fastened to the lining mounted inflatable protector and suitable for processing the data provided by the sensing means in order to identify a danger situation; and automatic enabling means suitable for automatically switching the control unit from a first operative mode to a second operative mode and vice versa; and wherein in the first operative mode the control unit being suitable for ignoring any identified danger situation and in the second operative mode the control unit being suitable for activating the at least one gas source when a danger situation is identified;

wherein said automatic enabling means are suitable for recognizing the identification means of the at least one garment and for switching the control unit to the second operative mode if the identification means of the at least one garment identifies a compatible configuration relative to fitting of said at least one garment with respect to the lining mounted inflatable protector whereby correct inflation of the at least one inflatable bag would likely be possible;

wherein the lining mounted inflatable protector and the garment are connected to each other by means of wired or wireless connections; and wherein the lining mounted inflatable protector is suitable for activating the at least one gas source for inflating the at least one inflatable bag when the sensing means identifies the danger situation but only when the control unit is in the second operative mode, and the control unit is suitable for being in the second operative mode but only while the garment is identified as being compatible relative to fitting with the lining mounted inflatable protector.

5. The protective clothing assembly according to claim 4, wherein the automatic enabling means comprise a radio frequency identification reader and the identification means of said at least one garment comprise a radio frequency identification chip suitable for storing classification data of said at least one garment, said radio frequency identification chip being adapted, once the lining mounted inflatable protector has been fastened to the garment, to be in range of the radio frequency identification reader of the automatic enabling means.

6. The protective clothing assembly according to claim 4, wherein the identification means of said at least one garment is suitable for storing classification data of said at least one garment and further comprising wire means suitable for connecting the identification means to the automatic enabling means of the lining mounted inflatable protector, the automatic enabling means being adapted to read, through the wire means, the classification data stored in the identification means.

7. The protective clothing assembly according to claim 4, wherein the identification means are suitable for identifying said at least one garment by establishing a coupling between one component of the identification means and a corresponding component of the control unit.

8. The protective clothing assembly according to claim 4, further comprising a display mounted on the outer surface of the garment in a position where the display is visible to the user; the display being provided with a cable having a plug at one end and said plug having a shape suitable for being inserted into a corresponding socket of the control unit, whereby insertion of the plug of the display inside the socket of the control unit is a condition which signals that the garment is compatible with the lining mounted inflatable protector.

9. The lining mounted inflatable protector according to claim 1, wherein the enabling means are suitable for maintaining permanently the control unit in the first operative mode both when no said data is acquired from the external source and when said data is acquired from the external source and signals the incompatibility between the lining mounted inflatable protector and the garment, regardless of any sensing of any danger situation by the sensing means.

10. The protective clothing assembly according to claim 4, wherein the lining mounted inflatable protector comprise first releasable fixing means suitable for cooperating with second fixing means of said at least one garment for removably fastening the lining mounted inflatable protector to the at least one garment.

11. The protective clothing assembly according to claim 4, wherein said at least one garment is provided with at least one yielding area which is substantially superimposed over at least one inflatable bag of the lining mounted inflatable protector, said at least one yielding area allowing said at least one inflatable bag to expand after being inflated by the gas source of the lining mounted inflatable protector.

12. The protective clothing assembly according to claim 7, wherein the one component of the identification means comprises a plug and the corresponding component of the control unit comprises a socket.

13. The protective clothing assembly according to claim 4, further comprising signaling means for generating signal configuration data relative to said at least one garment, wherein said automatic enabling means are suitable for recognizing the signaling means of the at least one garment and for switching the control unit to the second operative mode if the signaling means of the at least one garment identifies a compatible configuration of said at least one garment with respect to the lining mounted inflatable protector.

14. The protective clothing assembly according to claim 13, wherein the enabling means is suitable for reading said signal configuration data of the signaling means and for maintaining the control unit in the first operative mode if the signal configuration data identify an incorrect wearing of said at least one garment.

15. The protective clothing assembly according to claim 4, wherein the lining mounted inflatable protector and the garment are connected to each other by means of both wired and wireless connections.

16. The lining mounted inflatable protector according to claim 1, wherein the control unit when in the first operative mode is not suitable to activate the at least one gas source such that the at least one inflatable bag is correspondingly inflated, regardless of any sensing of any danger situation by the sensing means.

17. The protective clothing assembly according to claim 13, wherein the signaling means comprise a reed switch mounted at an opening of the garment, said reed switch being provided with a cable having at its end a plug and said plug having a shape suitable for being inserted into a corresponding socket of the control unit, the insertion of the plug of the reed switch inside the socket of the control unit is a condition which signals that the garment is compatible with the lining mounted inflatable protector.

18. The protective clothing assembly according to claim 14, wherein said signaling means comprise a reed switch and a magnet, the reed switch and the magnet being mounted on opposite sides of a central closure of the at least one garment.

19. The protective clothing assembly according to claim 13, further comprising a display mounted on the outer surface of the garment in a position where the display is visible to the user, the display being provided with a cable having a plug at one end and said plug having a shape suitable for being inserted into a corresponding socket of the control unit, whereby insertion of the plug of the display inside the socket of the control unit is a condition which signals that the garment is compatible with the lining mounted inflatable protector.

* * * * *